US007318263B2

(12) United States Patent
Stündl

(10) Patent No.: US 7,318,263 B2
(45) Date of Patent: Jan. 15, 2008

(54) DEVICE FOR COMPRESSION CRIMPING

(75) Inventor: Mathias Stündl, Wesel (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 605 days.

(21) Appl. No.: 10/482,489

(22) PCT Filed: Jun. 28, 2002

(86) PCT No.: PCT/EP02/07161

§ 371 (c)(1),
(2), (4) Date: Jul. 19, 2004

(87) PCT Pub. No.: WO03/004743

PCT Pub. Date: Jan. 16, 2003

(65) Prior Publication Data

US 2004/0237211 A1 Dec. 2, 2004

(30) Foreign Application Priority Data

Jul. 3, 2001 (DE) ..... 101 32 148

(51) Int. Cl.
*D02G 1/12* (2006.01)

(52) U.S. Cl. ..... 28/263; 28/265

(58) Field of Classification Search ..... 28/263, 28/264, 265, 266, 267, 268, 221, 258, 220, 28/254, 271, 272, 273, 274, 275, 276, 247
See application file for complete search history.

(56) References Cited

U.S. PATENT DOCUMENTS 2,949,659 A 8/1960 Heijnis (Continued)

FOREIGN PATENT DOCUMENTS

CN 013143 B 7/1991

(Continued)

OTHER PUBLICATIONS

Qiliang et al., "Analysis on the Structure and Properties of BCF Jet Texturing Unit",*China Synthetic Fibre Industry*, Dec. 1996, vol. 19, No. 6.

(Continued)

*Primary Examiner*—A. Vanatta
(74) *Attorney, Agent, or Firm*—Alston & Bird LLP

(57) ABSTRACT

The invention relates to a device for the compression crimping of a synthetic multifilament yarn, said device comprising a transport nozzle and a compression chamber. Said transport nozzle comprises a yarn channel by which means a yarn is guided to a compression chamber. Said compression chamber forms a section having a gas-permeable chamber wall, between a yarn inlet and an enmeshment outlet. According to the invention, the gas-permeable chamber wall comprises a friction surface consisting of material which is resistant to wear, on the inner side facing the yarn enmeshment. The constancy of the braking action produced by the friction on the yarn enmeshment can thus be significantly improved.

18 Claims, 3 Drawing Sheets

U.S. PATENT DOCUMENTS

| | | | | | |
|---|---|---|---|---|---|
| 3,237,270 | A | | 3/1966 | Dennis | |
| 3,710,460 | A | * | 1/1973 | Segraves | 28/271 |
| 3,808,654 | A | | 5/1974 | Stanley | |
| 3,935,621 | A | | 2/1976 | Weber | |
| 4,096,611 | A | * | 6/1978 | Heyner | 28/220 |
| 4,453,298 | A | * | 6/1984 | Nabulon et al. | 28/255 |
| 4,726,098 | A | * | 2/1988 | Conklin | 28/166 |
| 4,736,500 | A | * | 4/1988 | Goineau | 28/220 |
| 4,794,680 | A | | 1/1989 | Meyerhoff et al. | |
| 4,945,718 | A | * | 8/1990 | Stahlecker et al. | 57/333 |
| 5,351,374 | A | | 10/1994 | Nabulon et al. | |
| 5,390,400 | A | * | 2/1995 | Jacob et al. | 28/274 |
| 5,485,662 | A | * | 1/1996 | Hodges et al. | 28/263 |
| 5,768,877 | A | * | 6/1998 | Morhenne | 57/290 |
| 6,351,877 | B1 | * | 3/2002 | Harris et al. | 28/263 |

FOREIGN PATENT DOCUMENTS

| | | | |
|---|---|---|---|
| CN | 2279367 | Y | 4/1998 |
| JP | 04-343727 | * | 11/1992 |
| JP | 04 343727 | | 11/1992 |

OTHER PUBLICATIONS

Xinnan et al., "Filament Air-Jet Processing Method", *Synthetic Fibre*, 1998, vol. 3.

* cited by examiner

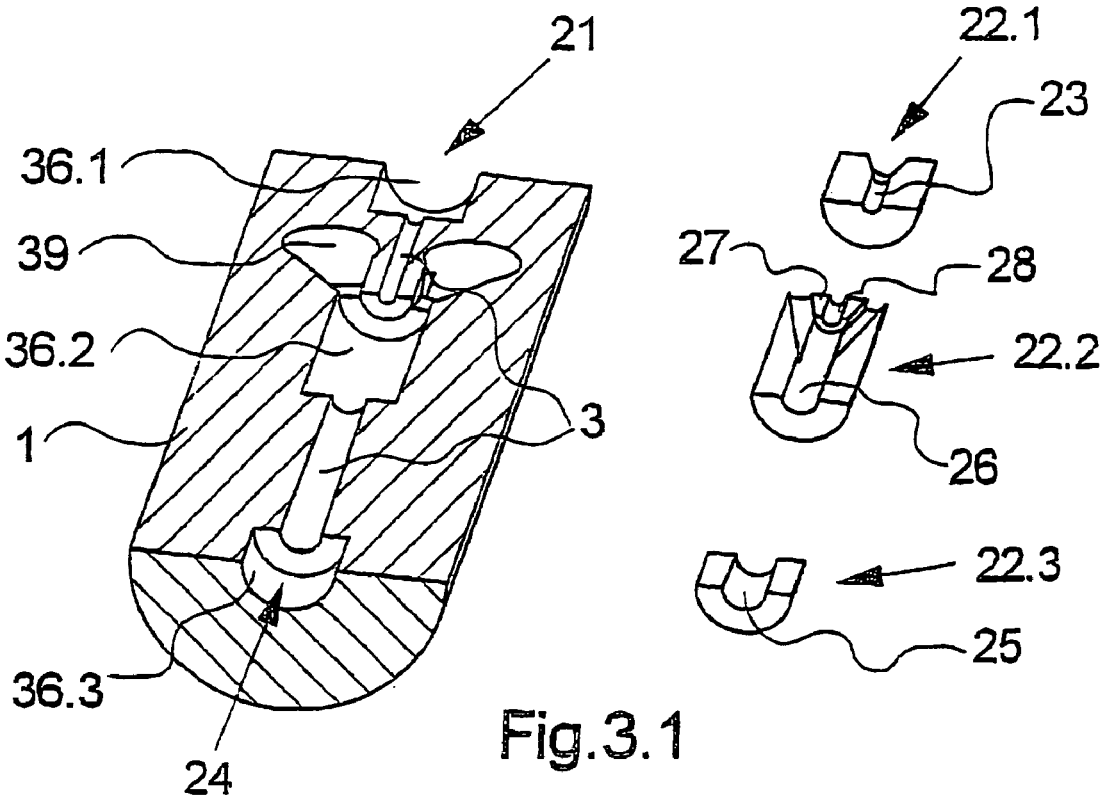
Fig.3.1
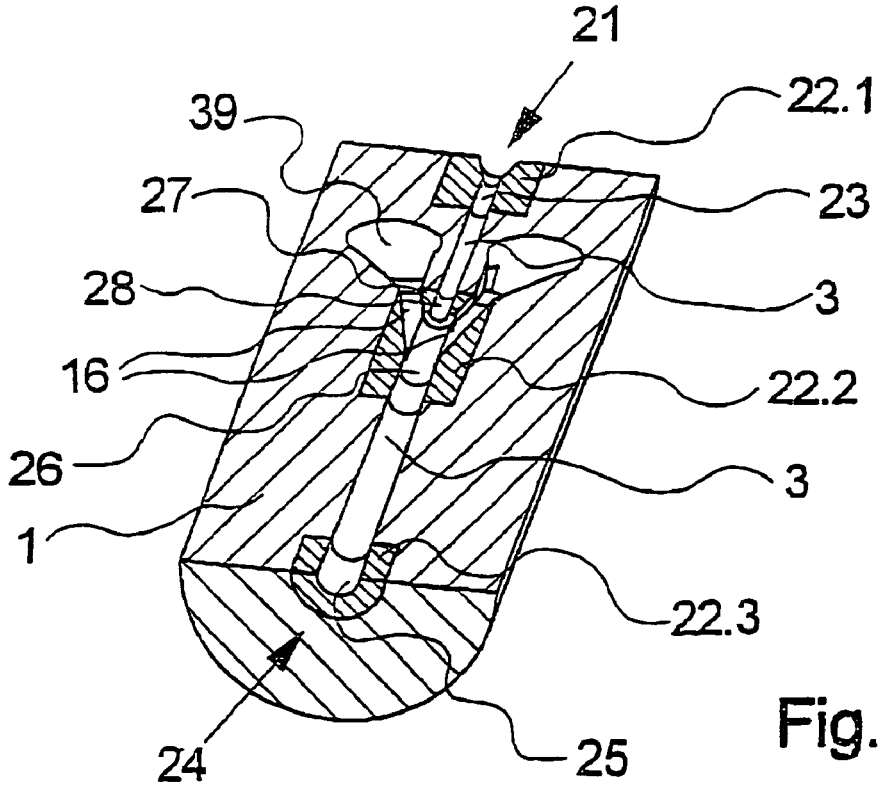
Fig.3.2

DEVICE FOR COMPRESSION CRIMPING

The invention relates to a device for the stuffer box crimping of a synthetic multifilament yarn.

The disclosure in German Patent Application 101 32 148.1 of Jul. 3, 2001 and PCT/EP02/07161 of Jun. 28, 2002 are incorporated herein by reference.

BACKGROUND OF INVENTION

An example of a device for the stuffer box crimping of a multifilament yarn is disclosed in EP 0 554 642 A1 and corresponding U.S. Pat. No. 5,351,374. The device comprises a conveying nozzle and a stuffer box arranged downstream from the conveying nozzle. The yarn is conveyed by means of the conveying nozzle into the stuffer box, compressed to a yarn plug and thereby stuffer box crimped. The conveying nozzle is loaded with a conveying medium, preferably a hot gas, which conveys the yarn within the yarn channel to the stuffer box. The yarn plug is formed inside the stuffer box. In doing so, the multifilament yarn deposits itself in loops on the surface of the yarn plug and is compressed by the conveying medium, which can discharge above the yarn plug out of the stuffer box. To do so, the chamber wall of the stuffer box comprises several slot-shaped openings on the perimeter through which the conveying medium can escape. In order to obtain uniform crimping of the yarn, plug formation must result with very high uniformity in the stuffer box. Thus, the friction forces caused by the relative motion of the yarn plug in the stuffer box have a substantial impact on the texturizing process. A counterbalance of forces exists between the conveying effect, or the dynamic pressure effect of the conveying medium flowing from the yarn channel of the conveying nozzle, and the braking action resulting from the friction forces on the yarn plug. Adjusting the conveying pressure, or adjusting additional suction of the conveying medium, essentially determines the conveying effect. In contrast, the braking action resulting from the friction between the yarn plug and the chamber wall essentially depends on the condition of the chamber wall.

In the device disclosed in EP 0 554 642 A1, only a slight number of friction surfaces exist due to the slot-shaped openings especially in the section with the gas-permeable wall. Therefore, wear marks are unavoidable in prolonged operation, which results in a change in the braking action. If the braking action decreases sufficiently, the yarn plug will be conveyed out of the stuffer box due to small frictional forces. The texturizing process then fails. On the other hand, as frictional forces increase, the yarn plug is no longer or no longer uniformly conveyed out of the stuffer box. Non-uniform stuffer box crimping occurs when a stick-slip effect begins in the stuffer box. These effects cannot be controlled with a dynamic medium opposing the conveying medium.

In contrast, one task of the present invention is to further improve a stuffer box crimping device for synthetic multifilament yarn in such a manner that uniform crimping is ensured in the yarn, even during very prolonged operation.

SUMMARY OF INVENTION

According to this invention, the task is solved by a device for compressing a synthetic, multifilament yarn, the device including a conveying nozzle and a stuffer box. The conveying nozzle includes a yarn channel for guiding and conveying the yarn. The stuffer box is arranged at the end of the yarn channel to form and collect a yarn plug. The stuffer box includes a yarn inlet, a plug outlet, and at least a section with a gas-permeable chamber wall between the yarn inlet and the plug outlet. The gas-permeable chamber wall includes a friction surface made of wear-resistant material on an inner side facing the yarn plug.

The friction surface of the section may be a coating applied to the surface of the gas-permeable chamber wall. Alternatively, the gas-permeable chamber wall is a ceramic material that forms the friction surface on the surface of chamber wall.

The gas-permeable chamber wall may be formed as a cylindrical body with elongated slots evenly distributed along the circumference. Alternatively, the gas-permeable chamber wall may be formed by a plurality of blades arranged in a ring-shape with little separation distance from each other.

The stuffer box may include an additional section downstream from the section with the gas-permeable chamber wall. The additional section includes an enclosed chamber wall. The enclosed chamber wall includes a contact surface made of wear-resistant material on the inner side facing the yarn plug.

As with the section, the friction surface of the additional section may be a coating applied to the surface of the enclosed chamber wall. Alternatively, the enclosed chamber wall is a ceramic material that forms the friction surface on the surface of chamber wall.

Further, the contact surfaces contacted by the yarn within the conveying nozzle may be at least partially formed from a wear-resistant material. The wear-resistant material may be in the form of a coating or a ceramic material.

The conveying nozzle may include a guide insert forming an inlet of the yarn channel. The guide insert includes an intake channel arranged as an extension of the yarn channel. Also, the conveying nozzle may include a second guide insert forming the outlet of the yarn channel. As with the guide insert, the second guide insert may be manufactured from a ceramic material or coated on its surface. Further, the conveying nozzle may include a third guide insert forming the air inlet into the yarn channel. The third guide insert forms a guide channel arranged as an extension of the yarn channel. The third guide insert forms an outlet channel arranged as an extension of the yarn channel. The guide inserts may be manufactured from a ceramic material or coated on its surface.

The third guide insert may further include an insert forming the inlet of the guide channel. The insert forms an intake channel arranged as an extension of guide channel. The inserts may be manufactured from a ceramic material or coated on its surface.

Any one of a conveying device, cooling device, and a conveying device in combination with a cooling device may be arranged downstream from the stuffer box in the yarn's direction of travel. The conveying device and the cooling device may include a coating on the contact surfaces contacted by the yarn plug.

The invention is based on the knowledge that depositing of the yarn on the yarn plug surface by self-shaping loops and coils significantly influences crimp uniformity. In order to maintain the yarn's point of impact on the yarn plug surface at an essentially unchanging height, the balance of forces between the conveying effect and the brake action at the yarn plug resulting from the friction must be held constant. This can be essentially achieved by the device according to this invention in that the gas-permeable chamber wall comprises a friction surface made of wear-resistant material on the inner side facing the yarn plug. Thereby, a change in the friction forces is not possible even in extended operation. Thus, the invention has the advantage that plug formation is solely controlled by controlling the conveying medium by, for example, means of pressure control.

The wear-resistant material on the surface of the chamber wall can be constructed essentially from two variants. In an initial especially preferred embodiment of the invention, the friction surface is formed by a coating applied to the chamber wall surface. This coating could consist, for example, of a ceramic material, a chrome oxide or a carbon coating. The possibility also exists to manufacture the chamber wall from aluminum in order to then form anti-wear protection by means of a hard oxide coating.

In another especially preferred embodiment of the invention, the friction surface is formed by a chamber wall manufactured from a ceramic material. To this end, the chamber wall can be manufactured out of ceramic materials such as zircon oxide, aluminum oxide or a combination of both.

The use of ceramic coatings, or ceramic materials, also achieves a corrosion-resistant gas-permeable wall and decreased fallibility to fouling. In particular, deposits caused by preparation residue may be avoided. Even after a maintenance period, the same friction specifications are achieved when operating the device as prior to shutting down the facility.

Regardless whether a coating or solid-ceramic is used to form the friction surface, the gas-permeable chamber wall can be designed as a cylindrical body with evenly distributed elongated slots along its circumference.

However, an especially preferred embodiment has a gas-permeable chamber wall with a plurality of blades that are arranged in a ring-shape with clearance from each other. Thus, it was observed in the use of ceramic blades that decreasing the friction coefficient subjects the yarn to less of a thermal and mechanical load.

In order to avoid wear inside the stuffer box on all sides contacting the yarn plug, an additional section with an enclosed chamber wall may be provided. In accordance with a preferred embodiment of this invention, the stuffer box includes an additional section with an enclosed chamber wall. The additional section is downstream from the section with the gas-permeable chamber wall. The enclosed chamber wall includes a contact surface comprised of a wear-resistant material on the inner side facing the yarn plug.

The contact surface could be formed by a coating applied to the surface of the chamber wall or by a chamber wall manufactured from ceramic material.

It was observed that when using a conveying nozzle with ceramic sides at least on parts of the surface contacting the yarn, that the yarn tension reduction in the conveying nozzle was reduced by the friction of the yarn on the side. In accordance with a preferred embodiment, the contact surfaces contacted by the yarn within the conveying nozzle are at least partially formed from a wear-resistant material in the form of a coating or a ceramic material. Thus, higher yarn tension can be achieved with the same conveying pressure, which results in higher operational uniformity of the texturizing process. On the other hand, yarn tension can be achieved with a lower pressure, whereby a lower conveying pressure results in less consumption of the conveying medium. The contact surface's wear-resistant material inside the conveying nozzle can be formed of coatings or ceramic base materials. Thus, the conveying nozzle can be preferentially manufactured entirely out of ceramics.

In another embodiment variant of the invention, the inlet of the yarn channel is formed by means of a guide insert in the conveying nozzle. The guide insert, which can be manufactured from a ceramic material or carry a coating on its surface, forms an intake channel as an extension of the yarn channel. Wear, in particular, at the yarn's entry into the conveying nozzle is thereby avoided. Using ceramic materials or ceramic coatings also enables a very low friction guidance of the yarn.

The conveying nozzle could also comprise a guide insert forming the yarn channel's outlet, which is also manufactured from a ceramic material or carries a coating on its surface. The yarn thereby leaves the conveying nozzle through the guide insert's outlet channel.

To convey the yarn, a conveying medium, preferentially hot air or a hot gas, is supplied. In order not to have any scouring in the yarn channel even at very high flow speeds, that may even lie in the range of the speed of sound, the air inlet into the yarn channel is formed by means of a guide insert, according to a preferred embodiment of the invention. Next to the air inlet, the guide insert comprises a guide channel that is arranged as an extension of the yarn channel. The guide insert is also made of a ceramic material or carries a coating on its surface.

Since the conveying medium flowing into the yarn channel results in a sudden dynamic load for the yarn, in a preferred embodiment of the invention, the third guide insert includes an additional insert forming the inlet of the guide channel. The additional insert forms an intake channel arranged as an extension of the guide channel. Also, the additional insert is either manufactured from a ceramic material or coated on its surface. The third guide insert in the area of the air inlet includes the additional insert in the inlet of the guide channel. In this manner, yarn guidance is stabilized and disturbances affecting the yarn are avoided.

To guide and condition the yarn plug, a cooling device is arranged downstream from the stuffer box at the plug outlet. In some cases a conveying device is provided between the cooling device and the stuffer box to guide the yarn plug. In order to avoid premature fouling and adhesion of preparation residue, in a preferred embodiment according to the present invention, the conveying device and the cooling device comprise a coating on the contact surfaces contacted by the yarn plug.

The invention is further described by means of several embodiments depicted in the attached illustrations.

BRIEF DESCRIPTION OF DRAWINGS

FIG. 3.1 schematically depicts an embodiment of a conveying nozzle in a cross-sectional, exploded view; and FIG. 3.2 schematically depicts an embodiment of a conveying nozzle in a cross-sectional view.

DETAILED DESCRIPTION

Figure 1:
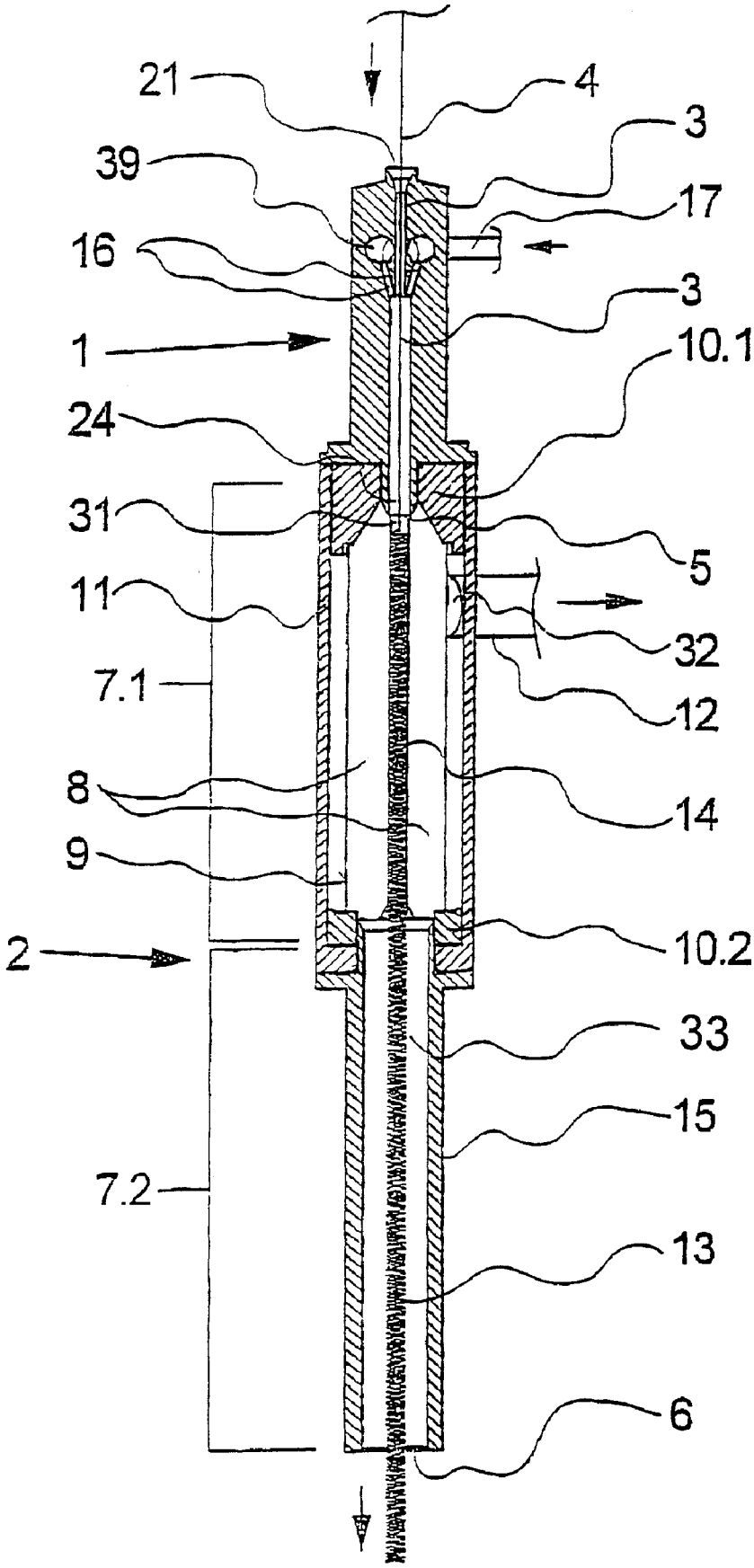
FIG. 1 schematically depicts an initial embodiment of the device in accordance with this invention in a cross-sectional view.

FIG. 1 schematically depicts a cross-sectional view of an initial embodiment of the device in accordance with this invention. The device consists of conveying nozzle 1 and stuffer box 2 arranged downstream from conveying nozzle 1. Conveying nozzle 1 comprises yarn channel 3 that forms inlet 21 on one end and outlet 24 on the opposite end. Conveying nozzle 1 is connected to a pressure source (not depicted) by means of feed line 17. Feed line 17 is connected to yarn channel 3 by air inlet 16 and pressure chamber 39. Air inlet 16 is formed by several boreholes that supply a conveying medium in yarn travel direction, marked by an arrow, to yarn channel 3. Yarn channel 3 merges into yarn channel 31 of stuffer box 2 by means of outlet 24.

Stuffer box 2 is formed by section 7.1 facing conveying nozzle 1 having yarn inlet 5, and section 7.2, arranged downstream from section 7.1, having a plug outlet 6. In section 7.1, plug channel 31 is formed by a gas-permeable chamber wall 8. Gas-permeable chamber wall 8 comprises a multiplicity of blades 9 that are arranged in a ring in close proximity to each other. Blades 9 are held by blade holders 10.1 on the upper end of section 7.1 and by holder 10.2 on the lower end of section 7.1. Blades 9 and holders 10.1 and 10.2 are arranged in housing 11, whereby housing 11 is enclosed to the outside and connected to suction 12 by opening 32.

On the side facing yarn plug 13, blades 9 each comprise friction surface 14. Blades 9 are made of a ceramic material so that friction surfaces 14 consist of a wear-resistant material.

Enclosed chamber wall 15 is provided below the gas-permeable chamber wall 8, which forms plug channel 33. Plug channel 33 is designed to have a larger diameter than the plug channel 31 in the area of the gas-permeable chamber wall 8. At its end, plug channel 33 forms plug outlet 6.

The embodiment of the device in accordance with this invention and depicted in FIG. 1 is shown with a yarn course in order to clarify the device's function. Thus, yarn 4 is transported through conveying nozzle 1 into yarn channel 3 by means of a conveying medium supplied via air inlet 16. Yarn 4 thereby enters into yarn channel 3 through inlet 21. Hot air or a hot gas are preferentially used as conveying medium. The conveying medium flowing at high speed conveys yarn 4 at high speed to stuffer box 2. In doing so, yarn plug 13 develops in plug channel 31. Yarn 4, comprised of a plurality of filaments, is deposited on the surface of yarn plug 13 in such a manner that the filaments form loops and coils. The conveying medium is suctioned off between and past blades 9 through opening 32. Yarn plug 13 forming in plug channel 31 abuts on friction surfaces 14 of blades 9. The friction forces and the conveying pressure of the conveying medium acting on yarn plug 13 are essentially counterbalanced so that the yarn plug height within the yarn channel 31 remains essentially the same. Since blades 9 are manufactured from a ceramic material, the counterbalancing forces acting on yarn plug 13 are essentially maintained by constant pressure of the conveying medium. After leaving plug channel 31, yarn plug 13 enters into plug channel 33 that is formed by enclosed chamber wall 15. Enclosed chamber wall 15 that could be constructed from a tube, for example, serves to feed yarn plug 13 to a downstream placed cooling device not depicted here. Plug channel 33 is designed larger than plug channel 31 so that only slight friction forces act on yarn plug 13. Anti-wear protection is therefore unnecessary.

Figure 2:
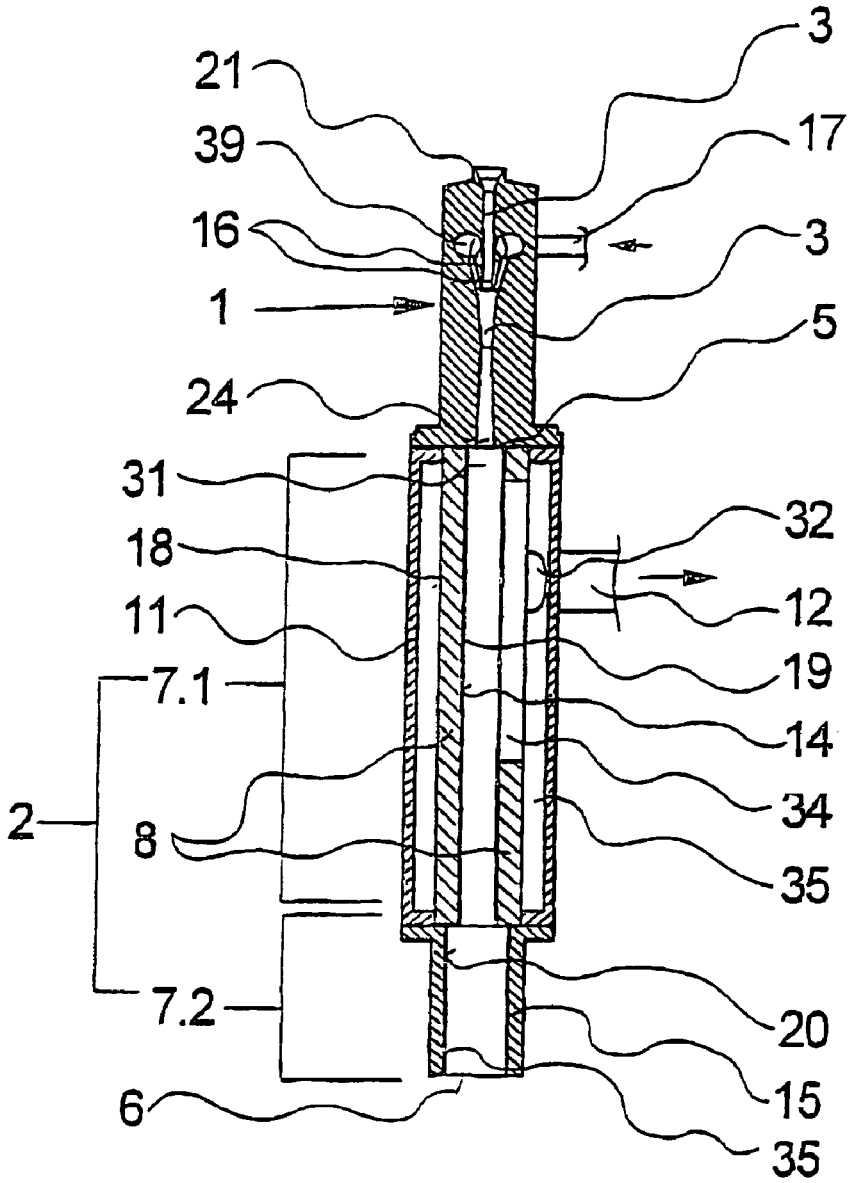
FIG. 2 schematically depicts an additional embodiment of the device in accordance with this invention in a sectional cross-section.
Figure 2:
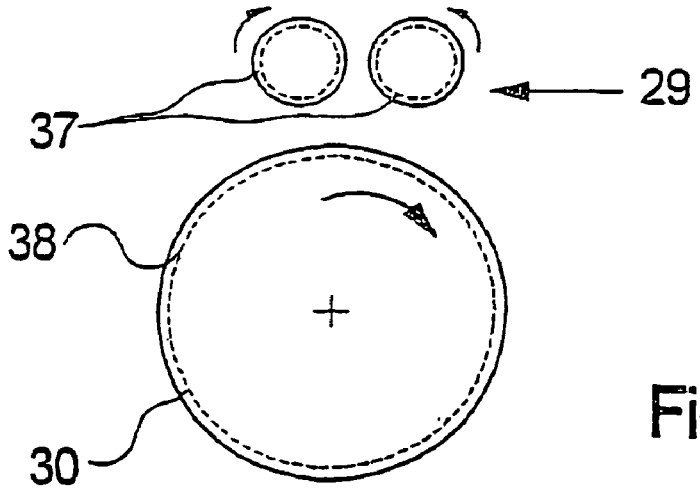

FIG. 2 schematically depicts an additional embodiment in a cross-sectional view. The embodiment is essentially identical in its design to the previous embodiment according to FIG. 1, so that hereafter only the essential differences will be pointed out. For clarity's sake, components having identical functions are identically labeled.

For additional acceleration of the conveying medium in yarn channel 3, conveying nozzle 1 comprises its smallest diameter directly downstream from air inlet 16. The conveying medium is thereby accelerated to a supersonic flow velocity. Yarn channel 3 merges into plug channel 31 that is formed by cylindrical body 18. cylindrical body 18 is arranged in the first section 7.1 of stuffer box 2. Cylindrical body 18 has distributed on its circumference several elongated slots 34, whereby plug channel 31 is connected to the annulus 35 which is formed between the housing 11 and cylindrical body 18. The annulus 35 is connected to suction 12 via the opening 32 in the housing 11. On the side facing yarn plug 13, cylindrical body 18 has a coating 19 which forms a friction surface 14 to guide a yarn plug. The coating 19 preferably consists of a ceramic material. However, metallic hard chrome layers or carbon compounds are also possible. Thus, cylindrical body 18 may also be manufactured from an aluminum material, which receives an aluminum oxide coating forming friction surface 14. Elongated slots 34 extend at least over a portion of cylindrical body 18. Elongated slots 34 extend at least over a portion of cylindrical body 18.

The second section 7.2 of the stuffer box is formed by enclosed chamber wall 15 that comprises plug channel 33. Plug channel 33 forms at its end plug outlet 6. On the side facing yarn plug 13, enclosed chamber wall 15 comprises contact surface 20 that also carries wear-resistant coating 35.

Formed out of two opposing rollers, conveying device 29 is attached directly to stuffer box 2 at plug outlet 6. Conveying device 29 guides the yarn plug 13 to a cooling device 30 arranged downstream from conveying device 29. Cooling device 30 could be constructed from a cooling barrel on whose circumference the yarn plug is cooled. Both conveying device 29 and cooling device 30 are furnished with a coating on their contact surfaces 37 and 38.

The function of the embodiment depicted in FIG. 2 is essentially identical to the previous embodiment according to FIG. 1, so that depicting the yarn course was not repeated. However, yarn plug development can be also influenced by conveying device 29.

FIGS. 3.1 and 3.2 schematically depict an embodiment of a conveying nozzle in a cross-sectional view as it might be used for example in the embodiment according to FIG. 1 or the embodiment according to FIG. 2. The conveying nozzle is thus depicted in FIG. 3.1 in a disassembled state and in FIG. 3.2 in an assembled state. The following description applies for both illustrations, unless express reference is made to one of the illustrations.

Conveying nozzle 1 comprises in the areas of inlet 21, air inlet 16, outlet 24, and grooves 36.1, 36.2, and 36.3 respectively.

Grooves 36.1, 36.2, and 36.3 are connected to each other by means of yarn channel 3. Pressure chamber 39 is designed in conveying nozzle 1 between grooves 36.1 and 36.2. Groove 36.1 in the intake section of conveying nozzle 1 serves to receive guide insert 22.1. Guide insert 22.1 forms an intake channel 23 that is arranged as an extension of yarn channel 3. Guide insert 22.1 is preferentially manufactured from ceramic material. However, it is also possible that guide insert 22.1 carries a coating in the area of the intake channel 23.

Guide insert 22.2 is inserted into groove 36.2. Guide insert 22.2 forms air inlet 16 through which the conveying medium is fed from pressure chamber 39 into guide channel 26 of guide insert 22.2. Guide channel 26 of guide insert 22.2 is arranged as an extension of yarn channel 3. Insert 27, which forms intake channel 28, is provided on the inlet side of guide insert 22.2. Intake channel 28 has a smaller diameter than guide channel 26 located downstream. Insert 27 and guide insert 22.2 may also be preferentially manufactured from a ceramic material or furnished with a coating.

Guide insert 22.3 is embedded in groove 36.3 on the outlet side of conveying nozzle 1. Guide insert 22.3 forms outlet channel 25 that is arranged as an extension of yarn channel 3 and forms outlet 24 of conveying nozzle 1. Guide insert 22.3 is also preferentially manufactured from a ceramic material.

The conveying nozzle depicted in FIGS. 3.1 and 3.2 consists of a wear-resistant material especially in the contact and friction areas heavily stressed by the yarn so that stable and uniform yarn guidance as well as yarn conveying are achieved. In addition, the friction coefficients between the yarn and the contact or friction points are substantially decreased.

In the device depicted in FIGS. 1 to 3, one should note that conveying nozzle 1 and stuffer box 2 are each preferentially formed out of two halves that are frictionally connected with each other during operation. However, it is also possible to basically provide one-piece conveying nozzles and stuffer boxes with corresponding ceramic inserts or coatings. Regardless of the device's design type, the possibility also exists, however, to manufacture each of the devices' yarn-contacting areas from solid ceramics or a coated aluminum material. The device according to this invention thereby distinguishes itself especially by a high degree of wear-protection and thus stable friction behavior and non-sensitivity to yarn conditioning, as well as a substantial lengthening of the cleaning cycles due to the resistance to fouling. Using a device in accordance with this invention, the service life was increased 3- to 5-fold. When using the device in accordance with this invention, which was furnished with ceramic materials or ceramic material coatings, crimping of the yarn could be kept uniform over a substantially longer period than compared to conventional crimping devices. A significantly higher degree of production safety is thereby achieved.

Reference List

1 Conveying nozzle
2 Stuffer box
3 Yarn channel
4 Yarn
5 Yarn inlet
6 Plug outlet
7 Section
8 Gas-permeable chamber wall
9 Blade
10 Blade holder
11 Housing
12 Suction
13 Yarn plug
14 Friction surface
15 Enclosed chamber wall
16 Air inlet
17 Feed line
18 Cylindrical body
19 Coating
20 Contact surface
21 Inlet
22 Guide insert
23 Intake channel
24 Outlet
25 Outlet channel
26 Guide channel
27 Insert
28 Intake channel
29 Conveyance device
30 Cooling device
31 Plug channel
32 Opening
33 Plug channel
34 Elongated slot
35 Annulus
36 Groove
37 Contact surface
38 Contact surface
39 Pressure chamber The disclosure in German Patent Application 101 32 148.1 of Jul. 3, 2001 and PCT/EP02/07161 of Jun. 28, 2002 are incorporated herein by reference. The German Patent Application and the PCT Application describe the invention described hereinabove and claimed in the claims appended hereinbelow and provided the basis for a claim of priority for the instant application.

While the invention has been illustrated and described as an embodiment of a device for compression crimping, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device for stuffer box compressing a synthetic, multifilament yarn into a yarn plug, the device comprising:

a. a conveying nozzle forming a yarn channel for guiding and conveying the yarn, the yarn channel comprising a contact surface at least partially formed from a wear-resistant material in the form of a coating or a ceramic material, and b. a stuffer box arranged at the end of the yarn channel for forming and collecting the yarn plug, the stuffer box comprising: a yarn inlet, a plug outlet, and a section between the yarn inlet and the plug outlet including a gas-permeable chamber wall comprising a friction surface comprising a wear-resistant material on at least the inner side of the chamber wall facing the yarn plug.

2. The device according to claim 1, wherein the friction surface comprises a coating on the surface of the chamber wall.

3. The device according to claim 2, wherein the coating comprises a ceramic material.

4. The device according to claim 2, wherein the coating comprises one of a chrome oxide and a carbon.

5. The device according to claim 2, wherein the chamber wall comprises aluminum and the coating comprises a hard oxide.

6. The device according to claim 1, wherein the chamber wall comprises a ceramic material that forms the friction surface on the surface of chamber wall.

7. The device according to claim 6, wherein the ceramic material comprises one of zircon oxide, aluminum oxide and combinations thereof.

8. The device according to claim 1, wherein the gas-permeable chamber wall comprises a cylindrical body with elongated slots evenly distributed along the circumference.

9. The device according to claim 1, wherein the gas-permeable chamber wall comprises a plurality of blade-like members arranged in a ring-shape with little separation distance from each other.

10. The device according to claim 1, further including one of a conveying device, a cooling device and a conveying device, and a cooling device arranged downstream from the stuffer box in the yarn's direction of travel, wherein contact surfaces contacted by the yarn plug of the conveying device and the cooling device comprise a coating.

11. The device according to claim 1, further including a first guide insert forming the inlet of the yarn channel, said first guide insert forming an intake channel arranged as an extension of the yarn channel and the first guide insert comprising a ceramic material or a ceramic material coating on its surface.

12. The device according to claim 11, further including a second guide insert forming the outlet of the yarn channel, said second guide insert forming an outlet channel arranged as an extension of the yarn channel and the second guide insert comprising a ceramic material or a ceramic material coating on its surface.

13. The device according to claim 12, further including a third guide insert forming an air inlet into the yarn channel, said third guide insert forming a guide channel arranged as an extension of the yarn channel and the third guide insert comprising a ceramic material or a ceramic material coating on its surface.

14. The device according to claim 1, further comprising an additional section with an enclosed chamber wall downstream from the section with the gas-permeable chamber wall, wherein the enclosed chamber wall comprises a contact surface comprising a wear-resistant material on the inner side facing the yarn plug.

15. The device according to claim 14, wherein the contact surface of the enclosed chamber wall is formed by a coating applied on the surface of the chamber wall.

16. The device according to claim 14, wherein the enclosed chamber wall comprises a ceramic material forming the contact surface on the surface of the enclosed chamber wall.

17. A conveying nozzle useable with a stuffer box which includes a yarn inlet, a plug outlet, and a section between the yarn inlet and the plug outlet including a gas-permeable chamber wall comprising a friction surface comprising a wear-resistant material on at least the inner side of the chamber wall facing the yarn plug to create a device for stuffer box compressing a synthetic, multifilament yarn into a yarn plug, the conveying nozzle comprising:

a yarn channel for guiding and conveying the yarn, a contact surface in the yarn channel and at least partially formed from a wear-resistant material in the form of a coating or a ceramic material, a first guide insert forming the inlet of the yarn channel, said first guide insert forming an intake channel arranged as an extension of the yarn channel and the first guide insert comprising a ceramic material or a ceramic material coating on its surface, a second guide insert forming the outlet of the yarn channel, said second guide insert forming an outlet channel arranged as an extension of the yarn channel and the second guide insert comprising a ceramic material or a ceramic material coating on its surface, and a third guide insert forming an air inlet into the yarn channel, said third guide insert forming a guide channel arranged as an extension of the yarn channel and the third guide insert comprising a ceramic material or a ceramic material coating on its surface.

18. The conveying nozzle according to claim 17, further including an insert forming the inlet of the guide channel of the third guide insert, said insert forming an intake channel arranged as an extension of guide channel and the insert comprising a ceramic material or a ceramic material coating on its surface.

* * * * *